United States Patent [19]

Bole et al.

[11] 4,048,803

[45] Sept. 20, 1977

[54] MINING SHIELD SUPPORT APPARATUS

[75] Inventors: Karoly Bole; Kalman Nagy, both of Varpalota; Istvan Aufsatz, Budapest; Jozsef Bohnert, Budapest; Laszlo Branyi, Budapest; Zoltan Ilyes, Budapest; Jozsef Korbuly, Budapest; Janos Nemeth, Budapest, all of Hungary

[73] Assignee: Banyaszati Kutato Intezet, Hungary

[21] Appl. No.: 531,165

[22] Filed: Jan. 17, 1975

[30] Foreign Application Priority Data

Dec. 3, 1974 Hungary BA ..... 3007

[51] Int. Cl.[2] ..... E21D 17/02

[52] U.S. Cl. ..... 61/45 D

[58] Field of Search ..... 61/45 D, 45 C, 85; 299/33

[56] References Cited

U.S. PATENT DOCUMENTS

| | | | |
|---|---|---|---|
| 3,216,202 | 11/1965 | Seddon | 61/45 D |
| 3,240,021 | 3/1966 | Meriaux et al. | 61/45 D |

FOREIGN PATENT DOCUMENTS

| | | | |
|---|---|---|---|
| 823,586 | 11/1959 | United Kingdom | 61/45 D |
| 882,933 | 11/1961 | United Kingdom | 61/45 D |
| 924,372 | 4/1963 | United Kingdom | 61/45 D |

*Primary Examiner*—Paul R. Gilliam
*Assistant Examiner*—David H. Corbin
*Attorney, Agent, or Firm*—Larson, Taylor and Hinds

[57] ABSTRACT

The invention concerns an advanceable shield support assembly for longwall mining. The assembly has a pivotable main roof cap housing a retractable and extensible auxiliary roof cap. Normally the main roof cap supports the roof and the auxiliary one is retracted. However, before the assembly is advanced, the auxiliary roof cap is extended to support the roof section between the working face and the front edge of the main roof cap. The movement of the auxiliary roof cap, and the force with which it engages the roof section, are controlled by cooperating guide tracks and track-engaging elements capable of exerting a wedging action.

1 Claim, 5 Drawing Figures

MINING SHIELD SUPPORT APPARATUS

Figure 1:
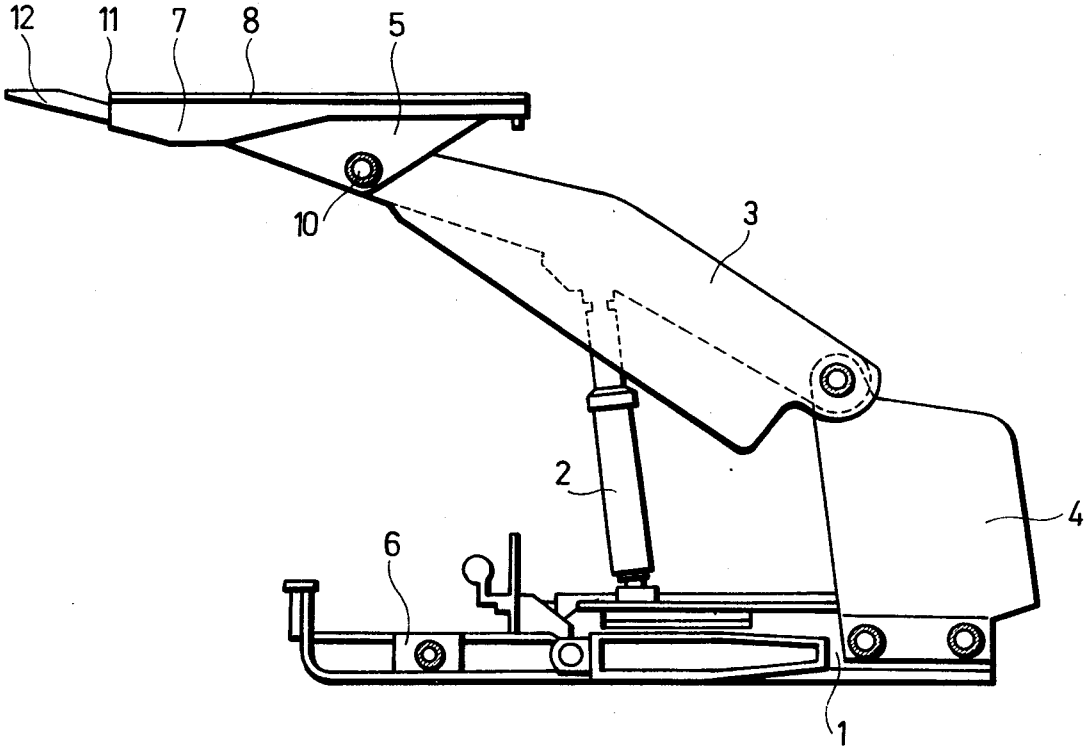

The invention concerns supporting apparatus for moving shields for use in longwall mining, which is intended to prop up the roof section between the working face established by a winning machine and the edge of the pivoting cap of the shield support apparatus, the propping being provided before the stepped advance of the shield support to an extent proportional to the magnitude of the pull of the winning machine and extending approximately to the working face.

The modern shield support devices belong among the support apparatus used in high-productivity longwall working systems using winning machines. These shield support devices are hydraulically operated steel constructions which are ranged in units along the front of the face and perpendicularly thereto; both in the period of winning and when they are one step further back they secure the roof against falls.

The base of the shield support device is constituted by the floor girder or bottom sill, the front of which engages under a cradle-like member provided with sliding cheeks. The cradle-like member carries a scraper belt and is constructed to be suitable also for advancing the latter hydraulically. On the goaf side, the base is releasably connected to a jack having an upper extension to which a fall shield is pivotally connected. The support of the fall shield and the attainment of the desired height are ensured by two hydraulic steel props which expediently engage in seats formed in the base. The pivotally displaceable roof cap is connected to a projecting forked part of the fall shield and serves to support the roof during longwall working.

The face-side edge of the pivoting cap does not extend to the front, but is disposed at a considerable distance from it which distance depends on the height of the roof cap and the working technology actually employed. It is generally not possible to support by props the part of the roof left free because the props would be in the way of the winning machine and would hinder its progress.

It has already occurred in the past that the roof has broken or the face has collapsed, and this increased the risk of accidents as well as hindered the advance of the winning machine and the continuity of conveying. The basic concept of the invention rests on the discovery that the above-mentioned drawbacks can be obviated by propping the roof, even before advancing the shield, between the edge of the pivotal cap of the shield and the coal face, to an extent proportional with the magnitude of the pull (grip) of the winning machine, approximately up to the coal face.

It has already been proposed to provide plate springs built into the roof cap and which, with the aid of mechanical means, impinged on and bore against the roof surface that became free. These springs were not, however, suitable for securing a continuous roof and thus the desired aim was not attained.

Mechanisms have been proposed wherein the roof-supporting roof cap is provided with an extension which could be bent up and which was moved hydraulically. The drawback of this solution is that owing to lack of space, the exertion of the supporting force takes place by means of a securing arm of small moment, as a result of which the support i.e. securing of the roof is unreliable. In the case of roofs of low strength the fall of smaller pieces only could be prevented, while the breaking off of larger, heavier pieces could not be stopped. As a consequence of this miners were exposed to the risk of accidents, and the winning and coveying ran into obstacles.

In addition to the elimination of the above disadvantages, the aim of the invention is to ensure continuity of production and to prevent accidents. This aim is solved by the mechanism according to the invention which consists in shield support apparatus for mining for supporting the portion of the roof between the working face and the front edge of the roof cap before advancing the shield support apparatus, comprising a base, prop means connected to the base, a roof cap pivotally connected to the prop means or to a member carried by the latter, a roof-engaging upper plate on said roof cap, a roof support member mounted for movement in the longitudinal axial direction of the roof cap between an inoperative position wherein it is retracted in the roof cap and an operative position wherein it is extended forwardly of the front edge of the roof cap, means for effecting said movement of the roof support member and at least one guide track member and at least one track-engaging element secured to said roof cap and said roof support member for mutual engagement and for guiding the movement of said roof support member.

Preferably, said roof cap includes side plates, there being two track members secured to each of said side plates, each track member having an inclined track portion to form a ramp.

Each track member may contain at least two track sections one of which is constructed and disposed to make an acute angle with the plane of said upper plate and the other of which substantially parallel with said upper plate.

Optionally, there are two pairs of track members, one pair being adjacent the working face side of the roof cap while the other pair is adjacent the pivotal connection of the roof cap, the track members of said one pair being farther apart than the track members of said other pair.

Preferably, there are two pairs of track-engaging elements on the roof support member, the track members each including sections that are engaged simultaneously by said track-engaging elements, said section being of equal length and of equal inclination relative to said upper plate of the roof cap.

A piston-and-cylinder unit may be pivotally connected to the roof support member for effecting displacement of the latter. The roof support member guided on a ramped cam track wedges in between the track and the roof with a force of a magnitude not hitherto obtainable with known machines.

A further advantage of the preferred embodiment of the invention is that the extensible roof support built-in with the roof cap, as well as the hydraulic jack for moving it, are located in positions sheltered from external effects or influences. The mechanism in no way interferes with the general traffic in the mine, does not limit the conditions in which use of the shield unit in mining takes place and can achieve the result expected from it without special constructional measures.

Figure 2:
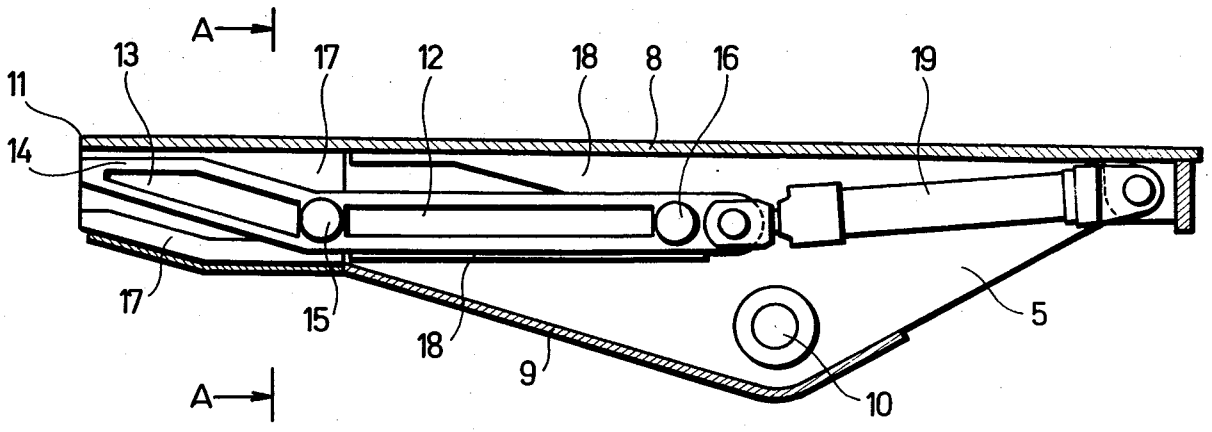
Figure 3:
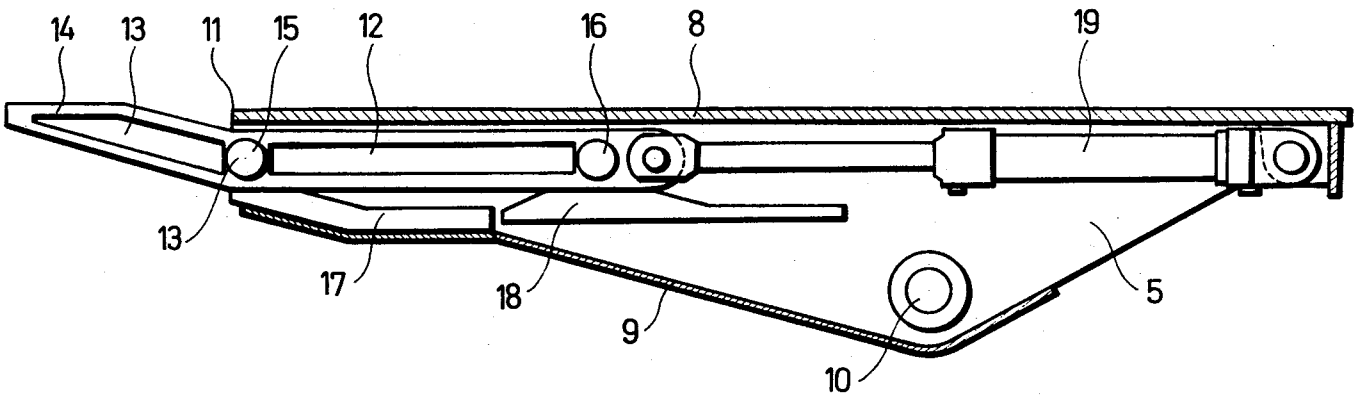
Figure 4:
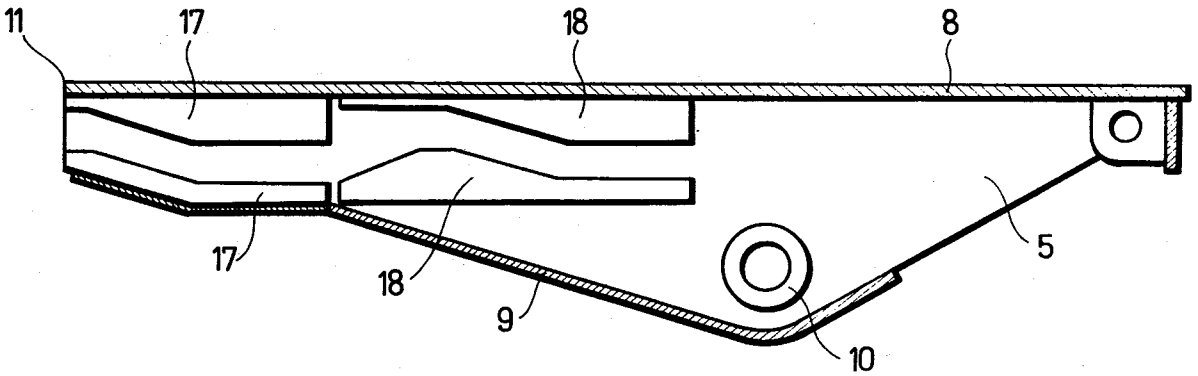
Figure 5:
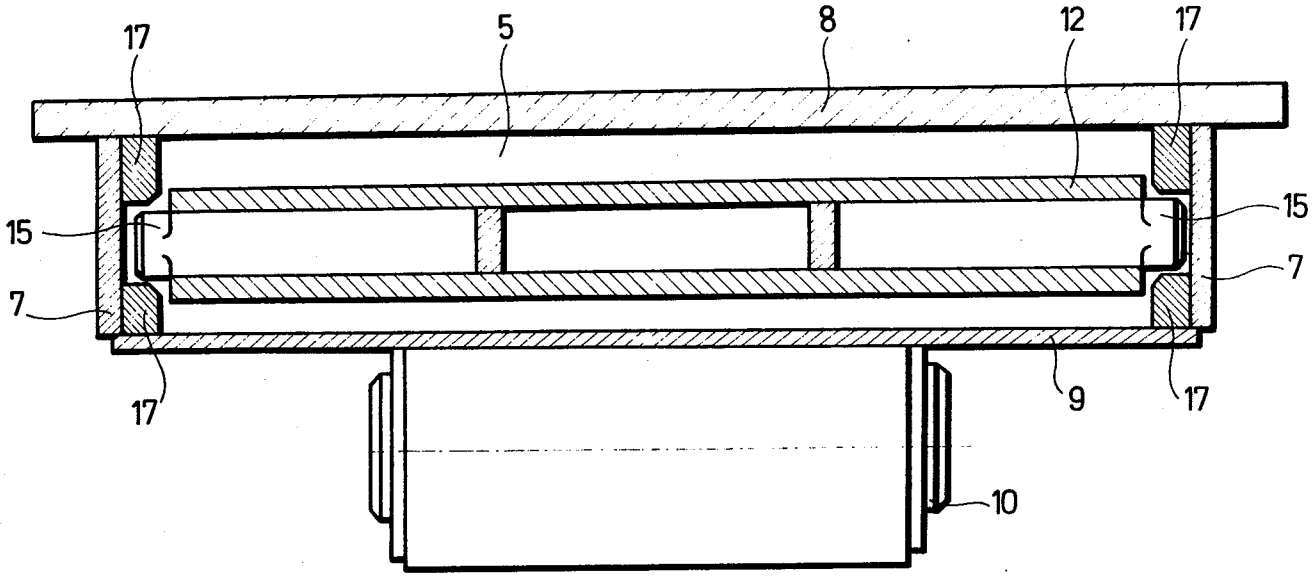

The invention is described in greater detail, by way of example only, with reference to the accompanying diagrammatic drawings illustrating a preferred embodiment, wherein:

FIG. 1 is a side elevation of the shield support mechanism according to this invention, FIG. 2 is an enlarged part-sectional, part-elevational view of the roof cap of the shield support mechanism of FIG. 1, shown in its retracted or inoperative position, FIG. 3 is an enlarged part-sectional, part-elevational view of the roof cap of the shield support mechanism of FIG. 1, shown in its extended or operative position, FIG. 4 is a fragmentary longitudinal section of the roof cap illustrating the guide means embodied therein and with certain details omitted for clarity, and FIG. 5 is a section taken along the plane A—A of FIG. 2.

Referring to the drawings, a shield unit of FIG. 1, which is generally known in itself and is a welded steel plate construction, consists of a base or bottom sill 1 supporting hydraulically operated props 2 which serve adjustably to support a fall shield 3 pivotally connected to the upper end of a jack 4 at the goaf end of the base 1. The forwardly (leftwardly in the Figures) projecting end of the shield 3 is forked and is connected to the roof-supporting pivotable cap 5 by way of a pivot bolt 10. A forwardly projecting part of the base 1 guides and carries a cradle-like member or crib 6.

The roof cap 5 is a hollow, box-like construction bounded by mutually parallel side walls 7, a cross-plate 8 connecting the latter at the top, and a partially open covering plate 9 at the bottom. The cross-plate 8 of the pivotable roof cap 5 is in its stressed state pressed against the roof and prevents the latter from collapsing. The edge 11 of the plate 8 is at a distance from the working face in the period when the winning machine operates and during the directly following that, the distance being in correspondence to the pull(s) of the winning machine or plane, and the edge 11 approaches the working face only during the advance of the shields. As already mentioned, the roof section between the face and the edge 11 remains unsupported.

A roof support 12 embodied in the invention has the role of terminating this critical condition. The roof support 12 is an auxiliary roof cap made of steel plates displaceable between a passive or inoperative terminal position shown in FIG. 2 wherein it is retracted under the covering and supporting plate 8 of the pivotable roof cap 5, and an active or operative terminal position shown in FIG. 3 wherein it is extended in front of the edge 11 of the plate 8. The front end of the roof support 12 has a wedge-like projection 13 with an upper plate 14 which expediently forms an extension of the plate 8 towards the working face.

Two pairs of pins 15, 16 project laterally from the roof support 12 and these pins engage a guide track formed by guide members 17, 18 secured to the inside of the side plates 7 of the roof cap 5 so as to be displaceable in the direction of the longitudinal axis of the support plate 8. The guide members 17, 18 are disposed in pairs mutually oppositely such that at their front (or, face-side) portion they include an acute angle with the plane of the support plate 8 so that these portions constitute ramps. Their rear portions adjacent the axis of rotation of the bolt 10 they are substantially parallel with the plane of the support plate 8. This constructional solution is an important feature of the invention and has the task of wedgingly stressing the roof support 12 in its extended position, where it is guided on the ramp, whereby to clamp the roof support 12 between the guide members 17 secured to the cap 5 and thus to exert a wedging force on the roof that has hitherto not been possible with known constructions.

A further advantage of the preferred embodiment of the invention is that the extension 13 of the roof support 12 can be wedged against the — usually uneven — roof even without pivoting the roof cap 5 without first exerting a greater force. The guide (cam) members 17 and 18 are arranged in pairs such that the members 17 at the face-side portion of the pivotable roof cap 5 are at a greater distance from each other than the distance between the guide members 18 disposed adjacent the bolt 10. The sections of the guide members 17 and 18 simultaneously engaged by the pins 15 and 16 of the roof support 12 are of the same length and form the same angle with the plane of the support plate 8 of the pivoting roof cap 5.

The roof support 12 embodied in the invention is connected by way of articulated elements to an hydraulic working piston and cylinder unit 19 disposed beneath the support plate 8, whereby to enable the support 12 to reciprocate in the general direction of the longitudinal axis of the pivoting roof cap 5. The unit 19 can be included in the hydraulic system of the shield support apparatus without the need for introducing any special constructional elements.

The mechanism according to the invention is operated as follows. When the non-illustrated winning machine has removed from the (coal) face a layer according to the size of its pull, with the shield support apparatus located in front of the face, the roof support 12 underneath the support plate 8 is immediately extended by actuating the hydraulic unit 19, thereby to secure the critical roof section. In the phase of the operation where the shield support can be advanced or stepped forward, the roof support 12 is retracted under the plate 8. In this phase the roof is supported directly by the pivoted roof cap 5.

We claim as our invention:

1. Shield support apparatus for use in long wall mining with a roof support member for supporting the portion of the roof between the working face and the front edge of a roof cap before advancing the shield support apparatus, said apparatus comprising a base, prop means connected to the base, a roof cap, pivot means for pivotally connecting the roof cap to the base and to the prop means, a roof support member, guides located in the sides of the roof cap, guide-engaging members for mounting the roof support member between said guides for movement in the longitudinal axial direction of the roof cap between an inoperative position wherein the roof support member is retracted in the roof cap and an operative position wherein said roof support member is extended forwardly of the front edge of the roof cap, and drive means for effecting said movement of the roof support member, said guides comprising, on each side of the roof cap, at least two tracks engaged by corresponding ones of said guide-engaging members carried by the roof support member, each said track comprising a first track portion substantially parallel to the plane of the roof cap and a second track portion disposed forwardly of said first and inclined forwardly and upwardly to form a ramp, said roof member being pivotally connected to said drive means for effecting movement of the roof support member so that when said roof member is moved by said drive means, said roof member moves from said inoperative position upwardly along said ramps of said first and second track portions to the operative position wherein the roof supporting surface of said roof support member is parallel to the upper surface of the roof cap, whereby a full surface wedging action of the roof support member against the roof is achieved in said operative position, said track portions being formed by two pairs of track members, one of said pairs being located adjacent the working face side of the roof cap and the other of said pairs being located adjacent the pivotal connection of the roof cap, the track members of said one pair being farther apart than the track members of said other pair.

* * * * *